US006776109B2

(12) United States Patent
Segars et al.

(10) Patent No.: US 6,776,109 B2
(45) Date of Patent: Aug. 17, 2004

(54) BOW AND SKEW CONTROL SYSTEM AND METHOD

(75) Inventors: Jeffery W. Segars, Cartersville, GA (US); William N. Vaughan, White, GA (US)

(73) Assignee: Columbia Insurance Company, Omaha, NE (US)

( * ) Notice: Subject to any disclaimer, the term of this patent is extended or adjusted under 35 U.S.C. 154(b) by 180 days.

(21) Appl. No.: 10/017,099

(22) Filed: Dec. 13, 2001

(65) Prior Publication Data

US 2002/0108550 A1 Aug. 15, 2002

Related U.S. Application Data

(60) Provisional application No. 60/255,593, filed on Dec. 13, 2000.

(51) Int. Cl.[7] ..... D05B 19/16; D05C 15/14

(52) U.S. Cl. ..... 112/80.23; 112/305; 112/323; 112/80.32

(58) Field of Search ..... 112/80.23, 80.3, 112/80.31, 80.32, 80.33, 470.03, 305, 318, 322, 272, 475.23; 250/559.29; 226/24, 27, 28; 26/51.5, 51.4

(56) References Cited

U.S. PATENT DOCUMENTS

| | | | | |
|---|---|---|---|---|
| 2,968,856 A | | 12/1961 | Allen | 26/51.5 |
| 3,688,804 A | * | 9/1972 | Brown et al. | 250/559.29 |
| 3,688,808 A | | 9/1972 | Uehera | 139/190 |
| 3,701,464 A | | 10/1972 | Crum | 226/3 |
| 3,721,203 A | | 3/1973 | George | 112/121.26 |
| 3,794,554 A | | 2/1974 | Caring | 161/109 |
| 3,908,881 A | | 9/1975 | McCann | 226/19 |
| 4,255,050 A | | 3/1981 | Beckstein et al. | 356/238 |
| 4,261,498 A | | 4/1981 | Short | 226/3 |
| 4,303,189 A | | 12/1981 | Wiley et al. | 226/15 |
| 4,364,502 A | | 12/1982 | Frentress | 226/45 |
| 4,401,024 A | | 8/1983 | Frentress | 101/93.01 |
| 4,656,360 A | | 4/1987 | Maddox et al. | 250/571 |
| 4,741,000 A | | 4/1988 | Fukuda | |
| 4,786,177 A | | 11/1988 | Beckstein et al. | 356/429 |
| RE32,967 E | | 6/1989 | St. John et al. | 242/57.1 |
| 4,890,924 A | | 1/1990 | Beckstein | 356/429 |
| 4,894,891 A | | 1/1990 | Beckstein | 26/51.4 |
| 4,899,425 A | | 2/1990 | Epple | 26/51.4 |
| 4,987,663 A | | 1/1991 | Epple | 26/51.3 |
| 5,035,030 A | | 7/1991 | Pellari | 26/51.5 |
| 5,110,314 A | | 5/1992 | Fujihara et al. | |

(List continued on next page.)

*Primary Examiner*—Peter Nerbun
(74) *Attorney, Agent, or Firm*—Needle & Rosenberg, P.C.

(57) ABSTRACT

A bow and skew reduction control system and method is disclosed. In a tufting machine, an elongate bow roll is positioned intermediate a supply of a backing material to be tufted and a cloth feed roll positioned upstream of a needle bar. The backing material is passed at least partially about the bow roll and is passed over the cloth feed roll and into a tufting zone positioned with respect to the needle bar. The bow roll is provided with an actuator operably coupled to a controller. The roll of backing material is supported at its respective ends by a pair of jack assemblies, the jack assemblies being constructed and arranged for independent operation, and for raising and lowering, respectively, the ends of the roll of backing material as instructed by the controller. At least one, or a plurality, of spaced weft yarn markers are formed or otherwise disposed on the backing material and are parallel with the weft yarns thereof. The weft yarn markers are detected by a control and detection system of which the controller is a part. If the control system determines that the weft yarn markers are not parallel to the needle bar, the controller will selectively instruct either the bow roller actuator, and/or the jack assembly actuators to increase or decrease the tension of the backing material passed into the tufting machine for aligning the weft yarns of the backing material with respect to the needle bar.

28 Claims, 4 Drawing Sheets

U.S. PATENT DOCUMENTS 5,188,047 A * 2/1993 Rohr et al. ..... 112/470.03
5,259,729 A 11/1993 Fujihira et al.
5,367,379 A 11/1994 Makino
5,416,593 A 5/1995 Vercruysse ..... 356/429
5,484,639 A 1/1996 Woodall et al. ..... 428/95
5,606,647 A 2/1997 Hasebe et al.
5,734,412 A 3/1998 Hasebe et al.
5,750,974 A 5/1998 Sasaki et al.
5,796,087 A 8/1998 Hazama
5,818,123 A 10/1998 Iwasaki et al.
5,866,892 A 2/1999 Umemoto et al.
5,895,535 A 4/1999 Bentz ..... 156/64
5,942,742 A 8/1999 Suhara
5,950,319 A 9/1999 Harris ..... 33/494
5,959,282 A 9/1999 Tabuchi
6,061,081 A 5/2000 Hasebe et al.
6,084,524 A 7/2000 Sato
6,084,681 A 7/2000 Keane ..... 356/430
6,094,272 A 7/2000 Okamoto
6,111,995 A 8/2000 Iwasaki et al.
6,124,936 A 9/2000 Okamoto
6,137,408 A 10/2000 Okada
6,140,633 A 10/2000 Iwasaki et al.
6,204,575 B1 3/2001 Yamaguchi
6,211,784 B1 4/2001 Nishide
6,236,036 B1 5/2001 Kudo et al.
6,239,423 B1 5/2001 Hama et al.
6,323,481 B2 11/2001 Ueki
6,384,555 B1 5/2002 Tanaka
6,392,214 B1 5/2002 Okamoto
6,414,603 B1 7/2002 Yamaguchi et al.
6,421,572 B1 7/2002 Koyama et al.
6,455,829 B1 9/2002 Fukumura
6,474,555 B1 11/2002 Tsunobuchi et al.
6,522,150 B2 2/2003 Fujita
2002/0067483 A1 6/2002 Lacovara ..... 356/431

* cited by examiner

BOW AND SKEW CONTROL SYSTEM AND METHOD

CROSS-REFERENCE TO RELATED APPLICATIONS

This application claims priority to provisional U.S. patent application Ser. No. 60/255,593, filed on Dec. 13, 2000, in the United States Patent and Trademark Office.

FIELD OF THE INVENTION

The present invention relates in general to a system and a method adapted to control bow or skew within a web of material to be processed. More particularly, the invention relates to a system and a method used to control any bow and/or skew that may be present within a backing material passed toward the needle bar of a tufting machine.

BACKGROUND OF THE INVENTION

As known, during the manufacture of carpet or other tufted work products, a primary backing material is supplied from a storage roll and continuously fed in a warp, i.e., a longitudinal or lengthwise, direction through a tufting machine. The tufting machine is provided with a reciprocating needle bar having a series of spaced tufting needles disposed thereon. The tufting needles are each threaded with the yarn to be tufted in the backing material, the needles being passed together through the backing material by the reciprocating motion of the needle bar as the backing material is moved or carried past the needle bar during machine operation to form tufts in the "face" of the backing material.

The backing material may comprise a woven, a non-woven, a knitted, or a needle punched fabric, as well a stitch bonded primary backing material. The backing material therefore comprises a plurality of yarns, fibers, or filaments extending both longitudinally in the warp direction and perpendicularly in a weft direction across the width of the backing material. As one skilled in the art appreciates, materials such as polypropylene, as well as polyesters, hemp, composites, blend, nylons, or cottons, can be used to form the backing material.

A problem that exists in the art, however, is that the backing material made within industry tolerances is often distorted, with the result that oftentimes the weft lines within the backing material will not be aligned with the needle bar of the tufting machine as the backing material is advanced toward the needle bar. Four specific alignment problems result from the backing material being misaligned with the needle bar of the tufting machine. These problems being a "bow," or a "skew" in the weft-oriented tufts tufted in the backing material, or the tufted yarns being "hooked," and/or extending along a wiggled weft line.

Bow exists within a tufted product when the weft yarns, fibers, or filaments in the backing material are not linear or straight, e.g., there is a curvature in the weft yarns relative to the needle bar. Skew, in comparison, exists when the weft yarns are not parallel to the needle bar, for example the weft yarns may extend along a straight line, but the line otherwise forms an angle relative to the needle bar. Hook exists when the weft yarns are oriented in a curved, or extend along a non-parallel, line or lines relative to the needle bar along at least a portion of their length, and appears at the edge(s) of the backing material. Wiggle exists when the weft yarns change from any combination of a positive to a negative angle relative to the needle bar in a specific section of the backing material.

Accordingly, when the problems of bow and/or skew occur within the tufts formed in the backing material, the tufted yarns are not parallel to at least a portion of the length of the weft line in the backing material. Thus, when attempting to join two adjacent carpet sections together along their respective weft lines, for example in a large space such as a public concourse or a ballroom, a noticeable difference can be seen in the tufted and/or printed carpet patterns from section to section of the carpet, which results in an undesirable or unsightly appearance in the installed carpet.

Examples of known devices and systems which attempt to address the problems of bow and skew in tufted products are found in U.S. Pat. No. 4,255,050 to Beckstein et al., U.S. Pat. No. 4,261,498 to Short, U.S. Pat. No. 4,364,502 to Fentress, and U.S. Pat. No. 5,035,030 to Pellari. Additional patents which may be relevant to this problem are U.S. Pat. No. 4,656,360 to Maddox et al., U.S. Pat. No. 4,987,663 to Epple, and U.S. Pat. No. 5,416,593 to Vercruysse.

What is needed, therefore, but seemingly unavailable among the known devices, is an improved system and a method for controlling, i.e., for reducing or eliminating to the greatest extent possible, the bow and skew of a backing material fed through a tufting machine.

SUMMARY OF THE INVENTION

The present invention overcomes some of the design deficiencies of the known art by providing an improved system and a method for controlling the presence of any bow and/or skew within a backing material to be fed through a tufting machine. This is accomplished by providing such a system and method in association for use with a conventional tufting machine having a reciprocating needle bar disposed with respect to a tufting zone through which the backing material is fed, a cloth feed roll positioned upstream of the tufting zone for moving the backing material toward the tufting zone, and a roll of backing material from which the backing material is supplied. The backing material may be of woven or of non-woven construction, and will be comprised of a plurality of elongate warp yarns, fibers, or filaments extending longitudinally in the lengthwise direction of the backing material, and a plurality of weft yarns, fibers, or filaments extending substantially perpendicular to the warp yarns and in the cross-length direction of the backing material. The terms yarn, fiber, and filament are used interchangeably herein, and refer to the aforementioned warp and weft yarns, fibers, or filaments within a woven or a non-woven backing material, respectively.

In a first embodiment, the method of the invention includes aligning at least one elongate weft yarn marker disposed on the backing material with the needle bar so that the at least one weft yarn marker is parallel to the needle bar. The at least one weft yarn marker is disposed on or within the backing such that it is parallel to the weft yarns of the backing material. This method may also include the aspect of detecting whether the at least one weft yarn marker is parallel to the needle bar as the backing material is passed toward the tufting zone.

The method may also include detecting a plurality of closely spaced and substantially parallel weft yarn markers formed as a group of weft yarn markers on the backing material, and of detecting a series of weft yarn marker groups spaced in the lengthwise direction of the backing material. In an alternate embodiment, the method comprises detecting the at least one weft yarn marker as the backing material is being passed toward the tufting zone, and aligning the at least one weft yarn marker with the needle bar so that the at least one weft yarn marker is parallel to the needle bar. This may be done with an automated detection device, or by manually observing the at least one weft yarn marker with respect to the needle bar of the tufting machine.

Yet another embodiment of the method therefore comprises physically observing, i.e., manually or visually detecting, the at least one weft yarn marker with respect to the needle bar as the backing material is passed toward the tufting zone, and aligning, either automatically or manually, the at least one weft yarn marker with the needle bar so that the at least one weft yarn marker is substantially parallel to the needle bar.

The method further comprises positioning a bow roll intermediate the roll of backing material and the cloth feed roll and used to selectively increase and decrease the tension of at least a portion of the backing material; and alternately, to increase and decrease the tension of a central portion of the backing material in response to the detection of the at least one weft yarn not being substantially parallel to the needle bar in order to control any bow that may be present in the weft yarns of the backing material with respect thereto.

The method also comprises mounting the roll of backing material on at least one jack assembly, or on a pair of spaced jack assemblies positioned at the ends of the roll of backing material, each such jack assembly being constructed and arranged to independently and selectively raise and lower the respective ends of the roll of backing material for increasing and decreasing the tension of at least a portion of the backing material, preferably the two spaced and separate portions thereof extending along the respective separate side edge portions of the roll of backing material, in response to the detection of the at least one weft yarn not being parallel to the needle bar, and for controlling any skew that may be present in the weft yarns of the backing material.

The system of the invention, adapted for use with a tufting machine as described above, includes in a first embodiment at least one weft yarn marker disposed on the backing material, the at least one weft yarn marker being parallel to the weft yarns of the backing material; at least one detection device positioned with respect to the needle bar and being constructed and arranged to detect the at least one weft yarn marker as the backing material is being passed toward the tufting zone; a bow roll positioned intermediate the roll of backing material and the cloth feed roll; and a controller operably coupled to the at least one detection device and the bow roll. This embodiment of the system may also comprise at least one jack assembly, or a pair of jack assemblies, as described and operated above, each such jack assembly being operably coupled to and controlled by the system controller. Each of the bow roll and the at least one jack assembly includes an actuator constructed and arranged to move the bow roll against the backing material, or to lift an end, or the ends, of the backing material supply, respectively, as desired.

The at least one detection device is preferably positioned downstream of the cloth feed roller, and parallel to the needle bar of the tufting machine. The at least one detection device may comprise a plurality of detectors, for example three such detectors, spaced from and aligned with one another in the weft direction of the backing material, and each of which is positioned parallel to the needle bar. The detector(s) will preferably be selected from among the group of detectors comprising optical, laser, magnetic, electronic, infra-red, and ultrasonic detectors, with the at least one weft yarn marker being selected from among of the markers within the group of markers comprising optical, laser readable, magnetic, electronic, infra-red, and ultrasonic markers.

The at least one weft yarn marker of the system preferably comprises a series of parallel weft yarn markers spaced from one another in the lengthwise or warp direction of the backing material, and each of which is parallel to the weft yarns of the backing material. In another embodiment, the at least one weft yarn marker comprises a plurality of closely spaced and parallel weft yarn markers disposed on the backing material and formed as a group of weft yarn markers, each of the weft yarn markers within the group being spaced from one another in the lengthwise direction of the backing material and being parallel to the weft yarns thereof. In a further aspect, therefore, there is a series of spaced groups of weft yarn markers extending in the lengthwise direction of the backing material. The weft yarn markers within each group of weft yarn markers are disposed parallel to the weft yarns of the backing material.

In each of the system embodiments, the controller is constructed and arranged to selectively instruct a first actuator operably coupled to the bow roll to move the bow roll against the backing material, and will also selectively instruct at least one second actuator operably coupled to each jack assembly to raise and lower at least one end of the roll of backing material, respectively, for increasing and/or deceasing the tension of the backing material passed toward the tufting zone in response to the detection of the at least one weft yarn marker not being substantially parallel to the needle bar. The controller may be automated, or manually operated, as desired.

The present invention is therefore particularly advantageous when positioning or laying sections of tufted carpet immediately adjacent each other as the carpet pattern alignment across the carpet seams should not be discernible due to the improved alignment of the weft yarns or filaments, such that the carpet will not exhibit bowing, skewing, hooking, or other distortions of the pattern that would create a visible pattern misalignment.

It is also contemplated using the present invention to properly align and tuft multiple primary backings simultaneously with a single tufting machine. In one embodiment, one tufting machine will tuft two primary backings in a side-by-side arrangement. Two separate systems of the present invention, one for each primary backing, may therefore be provided and each of which operates independently of the another. Alternately, therefore, the present invention allows for the alignment of a primary backing, a lower primary backing, or both of an upper and a lower primary backing, independently of each other.

DETAILED DESCRIPTION

Figure 1:
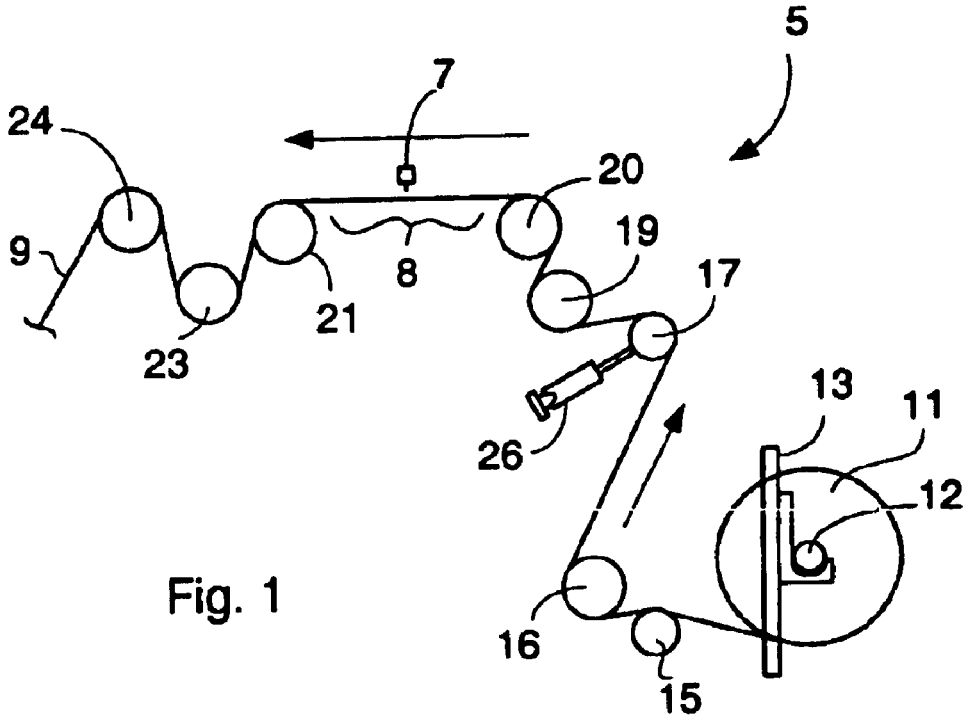
FIG. 1 is schematic illustration of a tufting machine supplied with a backing material from a roll of backing material.

Referring now in detail to the drawings, in which like reference characters indicate like parts throughout the several views, a tufting machine 5 is schematically illustrated in FIG. 1. The tufting machine is provided with an elongate needle bar 7 having a spaced series of elongate tufting needles (not illustrated) extending therefrom and toward a tufting zone 8 defined by the machine. A continuous web of a backing material 9 is passed through the tufting zone. As known, the backing material may comprise a woven or a non-woven material, for example a knitted or needle punched fabric, or a stitch bonded backing material, as desired.

As known, a woven backing material is formed of a plurality of warp yarns, fibers, or filaments extending in the longitudinal or lengthwise direction of the backing material, and weft yarns, fibers, or filaments extending in the lateral direction, i.e., the weft direction or width, of the backing material, with the weft yarns formed to be perpendicular to the warp yarns. In contrast, a non-woven backing material is formed of a plurality of fibers, for example polypropylene fibers, which fibers may also extend in the warp and weft directions. As one skilled in the art appreciates, materials such as polypropylene, polyesters, hemp, composites, blend, nylons, or cottons, can also be used to form the backing material. As used to herein, the term "yarn" refers interchangeably to either a yarn, a fiber, or a filament.

The respective needles on the needle bar are each threaded with a desired tufting yarn (not illustrated), and the needle bar is driven in reciprocating fashion for passing the tufting needles and the yarns into and back out of the backing material to form tufts of yarn in the face of the backing material, for example to tuft a carpet. It is understood, however, by those skilled in the art many different types of articles of manufacture can be produced on a tufting machine, and the invention herein is intended for use with the production of any type of a tufted article of manufacture, or with any type of tufting operation.

Figure 2:
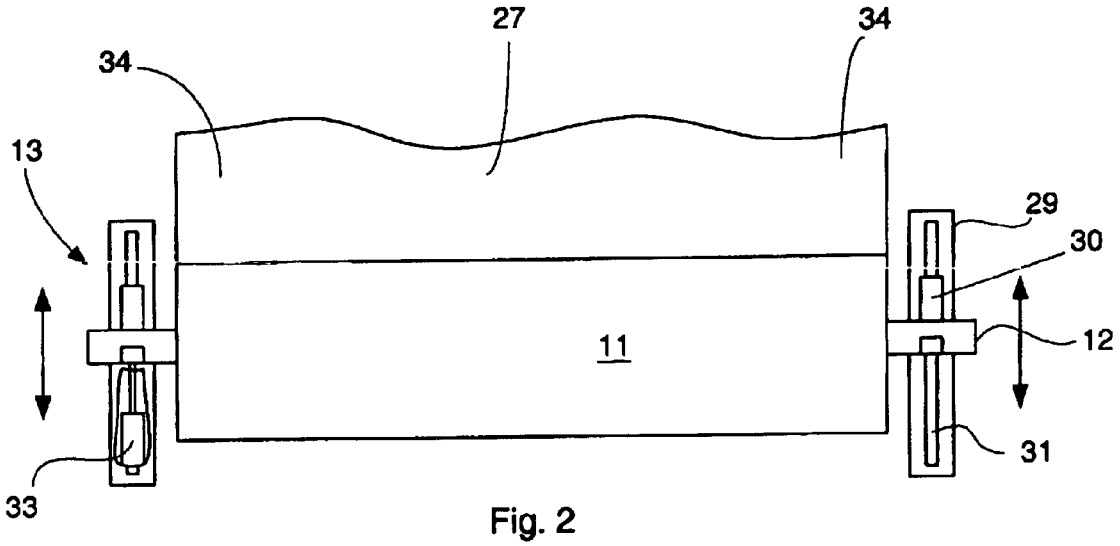
FIG. 2 is an elevational view of the roll of backing material supported on a pair of jack assemblies.

Still referring to FIG. 1, the backing material 9 is supplied to the tufting machine from a roll of backing material 11, which roll is positioned over an elongate shaft 12 supported at its ends by a pair of spaced jack assemblies 13 (FIGS. 1, 2). The backing material is extended from the roll of backing material over a first roll 15, and then partially about a second roll 16, which may, for example, comprise a pin roll. The backing material is then passed at least partially over a bow roll 17, provided as a part of the invention, and from there over a tension bar or roll 19, and is then received on a first cloth feed roll 20, typically a pin roll. The backing material then extends through the tufting zone 8 and is passed over another roll 21, about a portion of a second cloth feed roll 23 positioned downstream of the tufting zone, and then over another roll 24, whereupon the now tufted backing material is passed downstream for further processing or handling.

With the exception of the jack assemblies 13 and the bow roll 17 hereof, the construction and function of which are described in greater detail below, the tufting machine 5 is otherwise conventional such that the rolls 15, 19, 21, and 24 are formed as elongate rolls or bars, and can be either idle rolls/bars or powered/drive rolls, as desired. Similarly, the roll 16 may be an elongate stationary bar over which the backing material is passed, or may, for example, comprise an elongate pin roll of known construction and use. The tension bar 19 is typically an elongate bar, although it may comprise a roll if desired. Also, and as known to those familiar with tufting machines, each of the rolls 15, 16, 19, 20, 21, 23, and 24 are elongate rolls or bars extending in the lengthwise direction of the tufting machine, and over which the backing materials is at least partially passed. The tufting machine is also provided with a drive assembly (not illustrated) for reciprocating the needle bar 7, as well as with a drive assembly (not illustrated) for rotating at least the cloth feed rolls 20 and 23. Moreover, although not illustrated, but known to those skilled in the art, the needle bar may be shifted laterally with respect to the longitudinal length of the backing material during the tufting process, if so desired.

The bow roll 17 may comprise an elongate bar extending laterally across the width of the backing material, with the ends of the bar supported or carried on the frame (not illustrated) of the tufting machine. The bar version of the bow roll will be fixed at its ends, i.e., it does not rotate about its longitudinal axis, and is sized and shaped in its physical dimensions, material selection, and construction such that it may be flexed laterally with respect to its length, as described in greater detail below.

Alternately, the bow roll may be formed as an elongate roller constructed and arranged to rotate about its longitudinal axis, the spaced ends of the roller being rotatably supported on the frame of the tufting machine. In still another construction, the bow roll may be formed as a series of discrete rollers which together form the bow roller, and each of which is rotatably supported on and extends along a common axis or shaft. An elongate and continuous covering extending over all of the bow roll sections may be provided if so desired. So constructed the elongate bow roller, or the sectional bow roller, both of which comprise alternate embodiments of the bow roll, may be bowed by moving the ends of the roller shaft toward one another for flexing the bow roll, as desired. It is also anticipated that one or both of the ends of the bow roll shaft or bar could be twisted to impart a bow to the bow roll.

The bow roll is positioned downstream of the roll of backing supply backing material 11, and upstream of the cloth feed roll 20. Positioned mid span of the bow roll is an actuator 26 which is engaged with a central portion of the bow roll. So constructed, the actuator, in response to commands from the detection and control system 36 (FIG. 3), is adapted to move, i.e., flex. the center portion of the bow roll against the backing material in order to selectively increase and decrease, respectively, the tension of the backing material passed thereover. By selectively bowing or flexing the bow roll against the backing material, and more particularly against a central portion 27 (FIG. 2) thereof, the bow roll will increase or decrease the tension in the central portion for controlling, i.e., for minimizing or eliminating, any bow that may be present in the backing material with respect to the needle bar of the tufting machine, as described in greater detail, below.

As known to those of skill in the art, when a "bow" exists within a tufted product, the center portion of the weft yarns, 45 (FIGS. 6A, 6B) are bowed or arched with respect to the needle bar. Bow thus occurs in the central portion of the backing materials/tufted product. This being the case, when tufts are formed within the bowed backing material, subsequent processing will tend to straighten the backing material thus causing the tufted pattern to become distorted and no longer appear parallel to the needle bar or the weft lines of the backing material. When joining two sections of carpet together along their respective warp direction lines or seams, therefore, discernible differences in the patterns may be seen which results in an undesirable appearance in the installed carpet.

The actuator 26 comprises a known type of actuator, and preferably comprises a linear actuator. The actuator will be mounted or otherwise supported at its first end on the frame (not illustrated) of the tufting machine, and its opposite or second end will be engaged with the center-most portion of the bow roll. The actuator 26 may also comprise a hydraulic cylinder, a screw actuator, or a rack and pinion device, all as desired. What is important is not the construction of the actuator itself, rather the fact that the actuator is provided to selectively flex the bow roll. It is anticipated that the bow roll can be flexed as much as one and one half inches from dead center in either direction toward, i.e., into, and away from the backing material such that the actuator will move or flex the center portion of the bow roll through a range of approximately three inches.

Referring now to FIGS. 1 and 2, and as best shown in FIG. 2, the jack assemblies 13 positioned at the ends of and supporting the shaft 12 carrying the roll of backing material are illustrated in greater detail. Each of the jack assemblies is comprised of a elongate frame or a rack 29 on which a carrier 30 is supported for movement in the lengthwise direction of the frame. The respective carriers are each constructed and arranged to carry or support the ends of shaft 12. An elongate slot or track 31 is defined within the frame, and a portion of the carrier is extended therethrough and engaged with an actuator 33 constructed and arranged to move the respective carriers upwardly and downwardly within their respective tracks 31. Each of the actuators 33 is selectively and independently controlled by the detection and control system 36 illustrated in FIG. 3, and comprise conventional actuators. Accordingly, each of the actuators 33 is a known type of actuator, and each preferably comprises a linear actuator. The actuators 33 may thus comprise a hydraulic cylinder, a screw actuator, or a rack and pinion device, as desired.

The shaft 12 passed through the roll of backing material 11 is received on the respective carriers. It is not anticipated that the shaft 12 will rotate on the carriers, rather the roll of backing material will rotate about the shaft on the core (not illustrated) or tube about which the roll of backing material is wrapped during manufacture of the backing material. This will allow for the easy change out of rolls of backing material when the first roll gets exhausted and a second roll is required, and follows the currently accepted practice in carpet mills. However, it is anticipated that replaceable carrier assemblies (not illustrated) may be provided and used, in which the ends of the shaft 12 are held in suitable bearings, for example journal or roller bearings, and the shaft affixed to the roll 11 so that the shaft and the roll rotate together. As illustrated in FIGS. 1 and 2, however, it is anticipated that the roll of backing material will rotate on the shaft, the shaft remaining in a non-rotational position By moving the respective ones of the jack assemblies 13 upwardly or downwardly, respectively, the tension within the respective edge portions 34 (FIG. 2) of the backing material can be increased and decreased, respectively. For example, it is anticipated that if the shaft 12 is raised at one end, that a greater amount of tension will be put on the edge portion 34 of the backing material along the edge of the backing material extending from that end of the roll of backing material, particularly if the backing material is passed under a roll 16 as illustrated in FIG. 1. Similarly, if the end of the shaft 12 is lowered, the amount of tension in the edge portion 34 will be decreased. By selectively increasing and decreasing the tension in the edge portions of the backing material, the skew, i.e., the angular misalignment of the weft yarns with respect to the needle bar, can be controlled.

Figure 3:
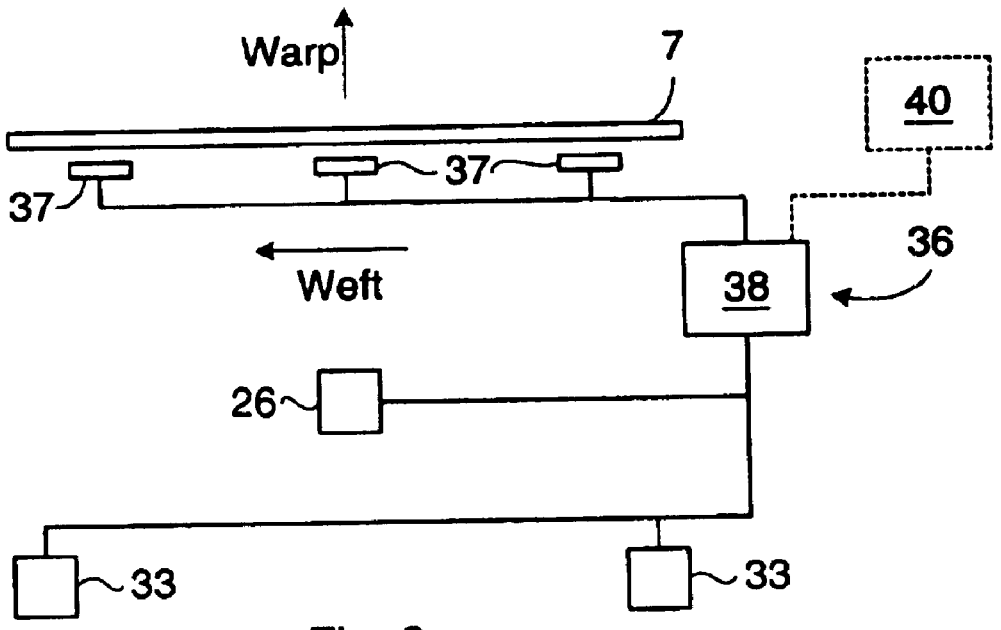
FIG. 3 is a schematic illustration of the detection and control system of the invention.

The detection and control system 36 for use with the invention is illustrated in FIG. 3. The system comprises at least one detector 37 positioned with respect to, i.e., parallel to, the needle bar 7. Preferably a plurality of detectors 37 are provided, for example three, and which are positioned longitudinally along a common axis and are positioned parallel to the needle bar of the tufting machine. It is preferred that the detectors 37 be positioned downstream of the cloth feed to read or scan the weft yarn markers after the backing material has been passed over the cloth feed roll in order to ensure that the weft yarns will be aligned parallel to the needle bar before passing over the cloth feed roll, and will otherwise remain parallel to the needle bar as the backing material passes through the tufting zone. The detectors are of known construction, and may comprise one, or a combination of, an optical, a laser, a magnetic, an electronic, an infra-red, and/or an ultrasonic detector, dependent on the type of material used to form the weft yarn markers present on or within the backing material.

Each of the detectors 37 is operably coupled to a controller 38, for example a computer or a microprocessor of known construction and operation. The controller is constructed and arranged to receive the electronic detection signals emitted by the detectors, and compare this data to a database of stored positional values therein. If the controller determines that a bow is present within the weft yarn markers 42, 42' (FIGS. 4A, 4B) of the backing material, the controller will send a command to the actuator 26 to move the bow roll 17 into or out of the backing material 9 (FIG. 1) as needed to increase or decrease, respectively, the tension within the central portion 27 (FIG. 2) of the backing material. This will be done to minimize, if not eliminate entirely, any bow that may be present in the backing material prior to the tufting of the yarns within the backing material.

Where, for example, skew is detected in the backing material with respect to the needle bar by the detectors, the controller 38 will issue a command to either one or both of the actuators 33 of the respective jack assemblies 13. The respective actuators 33 will then either independently raise and/or lower the respective carrier 30 provided as a part of the jack assembly, to increase or decrease, respectively, the tension within the edge portions 34 (FIG. 2) of the backing material as it is passed toward the tufting zone 8 (FIG. 1).

The controller 38 of the detection and control system 36 is shown, through a broken line, as being operably coupled, i.e., in communication with, a controller 40 of the tufting machine. It is anticipated that the controller 38 can be networked with the controller 40 of the tufting machine, or can be formed as a part of the tufting machine controller, if, and as desired. Where, for example, the bow and skew control system of this invention is retrofit to a tufting machine, the controller 38 may be provided separately of the tufting machine controller and will be otherwise networked to or communicate with the tufting machine controller. It is also anticipated, however, that the tufting machine controller could be expanded by the addition of the appropriate input-output cards and control logic/program, and then used to operate the described bow and skew system. Where, for example, the bow and skew control system described herein is incorporated into the tufting machine during its manufacture, it is conceivable that the tufting machine controller and the detection and control system controller will be a common controller, i.e., computer or microprocessor.

The controller 38, or its equivalent, as described above, is provided with a suitable control program and with a database of stored positional values, such that it can determine from the signals received from the respective detectors 37, the detectors scanning the respective spaced weft yarn markers 42 (FIG. 4A), and 42' (FIG. 4B), whether the center portion 27 of the backing material is bowed with respect to the needle bar, or whether the edge portions 34 are skewed with respect to the needle bar. As described above, the controller 38 will then send command signals to either the actuator 26 for flexing the bow roll 19, and/or to either one or both of the actuators 33 for raising or lowering the jack assemblies 13, respectively, to increase or decrease the tension within the backing material passed toward the tufting zone of the tufting machine.

It is anticipated that the controller 38 will operate each of the actuators 33 independently such that one can be raised and one can be simultaneously lowered, that one can be raised or lowered and the other left stationary, or that both can be raised or lowered together or in differing degree for controlling any skew detected within the backing material. Moreover, and if for example it is intended to induce a deliberate bow or skew in the article being tufted, it is anticipated that the controller 38 can be programmed to induce a bow in the backing material by controlling the actuator 26 to flex the bow roll 17, and/or by moving the actuators 33 of the jack assemblies 13, for moving the weft yarns of the backing material away from being parallel with the needle bar, as desired.

Figures 4A, 4B:
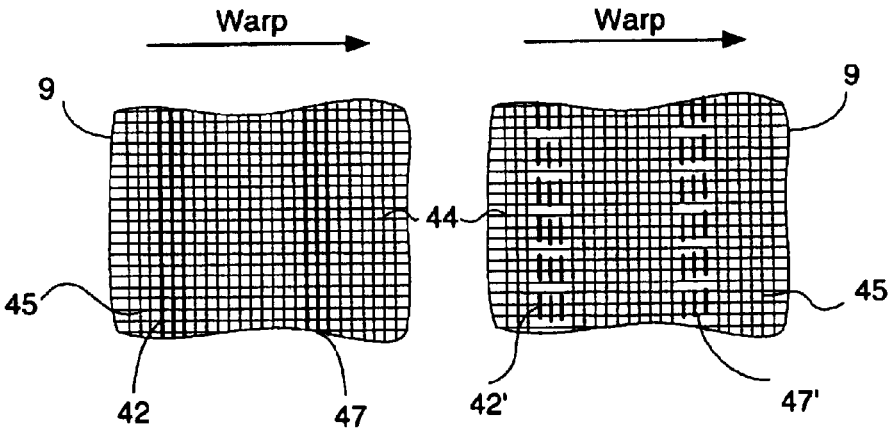
FIG. 4A is a partial plan view of a first embodiment of the weft yarn markers of the invention.
FIG. 4B is a partial plan view of a second embodiment of the weft yarn markers of the invention.

Referring now to FIGS. 4A and 4B, two exemplary embodiments of the weft yarn markers 42, 42', for use with the backing material 9 are illustrated. As known, and as described above, the backing material 9 has a plurality of spaced and parallel elongate warp yarns 44 extending in its longitudinal direction. The backing material is also provided with a plurality of spaced weft yarns 45, each of which extends in the lateral or width direction of the backing material. The weft yarns are each formed to be parallel to one another, and perpendicular to the warp yarns 44. At least one weft yarn marker 42 is formed or marked on the backing material, and is capable of being detected by the detector(s) 37 of the detection and control system. The weft yarn marker 42 may be an elongate continuous yarn or filament as shown in FIG. 4A, or may comprise a series of spaced markings or other indicia 42', as shown in FIG. 4B.

The weft yarn markers of the system comprise, at a minimum, a series of single and parallel weft yarn markers 42, 42' spaced from one another in the lengthwise or warp direction of the backing material, each such weft yarn marker being parallel to the weft yarns of the backing material. Alternately, and as illustrated in FIGS. 4A and B, a plurality of the weft yarn markers, for example three weft yarn markers, are closely spaced from, and positioned parallel to one another such that they are formed into a group 47, 47' of weft yarn markers. As for the single weft yarn markers, each weft yarn marker within the group of markers extends parallel to the weft yarns of the backing material. There will be a series of such weft yarn marker groups spaced from one another in the lengthwise direction of the backing material, and parallel to the weft yarns of the backing material, as shown.

In an illustrative embodiment, these groups of weft yarn markers will be spaced approximately every three feet apart along the length of the primary backing material, although one skilled in the art will appreciate that other spacing arrangements are possible. The ultimate spacing of the groups of weft yarn markers chosen will, however, be a function of the speed of the backing material moving toward and through the tufting machine, the processing speed of the controller 38, the ability of the detectors 37 to detect the weft yarn markers, the accuracy of the control system or the person manually controlling the bow and skew control system, and other similar considerations.

As shown in FIGS. 4A and 4B, the weft yarn markers may comprise one or more distinct weft yarns, fibers, filaments or lines that are formed into or printed on the backing material 9 at one specific section of the backing. For example, in one embodiment, the weft yarn markers 42, 42' on the backing material 9 may be formed of a different color from the warp and weft yarns therein. It is anticipated that for any of the weft yarn markers used may be added by the manufacturer of the primary backing, or may be placed thereon by the manufacturer of the articles being tufted. Alternate embodiments of the weft yarn markers 42, 42', provided as visual indicators include not only colored stripes, but may also include light reflective stripes which can be optically detected, read by a laser, or may be magnetic stripes or markings, each of which can visually observed and/or automatically detected by the detectors 37.

Optical detectors are known to the art, one design of which is disclosed in U.S. Pat. No. 4,303,189, the provisions of which are fully incorporated herein by this reference. Where the weft yarn markers 42, 42' comprise magnetic yarns or indicia, the detectors 37 will be magnetic sensors used to sense the position of the weft yarn markers with respect to orientation of the needle bar. Known embodiments of magnetic detectors are disclosed in U.S. Pat. Nos. 4,261,498, and 4,364,502, respectively, each of which is also incorporated herein fully by this reference. In the alternative, the present invention also contemplates the use of laser, ultrasonic, and/or infrared detectors, which may detect weft yarn markers 42, 42' adapted for laser, ultrasonic, and/or infrared detection.

Aside from the presence of the weft yarn markers 42, 42' in the backing material, the weft yarn markers may be formed by the absence of one or more of the weft yarns of the backing material. Still other embodiments of the weft yarn markers may be provided by forming one or more of the weft yarns of a different material than the remainder of the backing material, which yarns may or may not be readily distinguishable to the human eye, but could be monitored by an electronic detection device. All that is required is that the weft yarn marker be distinguishable to either the detection system, or otherwise visually detected if a person is going to visually detect the weft yarn markers and manually operate the control system 36.

So constructed, the detection device, whether it be automated or the function performed by a person, will detect or otherwise sense or observe the weft yarn markers 42 to determine that they are aligned with and parallel to the tufting machine needle bar as the backing material is passed into the tufting zone. If the weft yarn markers are not parallel to the needle bar, then the detection and control system will, or a person can, adjust the backing material to correct the alignment of the weft yarn markers by causing the actuator 26 to increase or decrease the tension in the central portion of the backing material with the bow roll 17, or can cause one or both of the jack assemblies 13 to raise for increasing the tension of the edge portions 34 of the backing material, or lower for decreasing the tension therein, for the purpose of controlling, namely to minimize or eliminate, any bow or skew that may be present in the backing material as it is passed into the tufting zone.

In usage, therefore, and in its simplest form, the method of controlling the bow and skew of the backing material fed through the tufting machine is to align at least one elongate weft yarn marker, a series of spaced single weft yarn markers, or groups of weft yarn markers, disposed on the backing material so that the weft yarn markers are parallel to the needle bar as the backing material is passed into the tufting zone of the tufting machine. The control method also includes detecting the weft yarn markers disposed on the backing material as the weft yarn markers are passed toward the tufting zone, and aligning the weft yarn markers, no matter how many or how formed, with the needle bar so the weft yarns of the backing material are parallel to the needle bar as the backing material passes through the tufting machine.

This may be done with the automated detection system discussed above, or manually. If any bow is detected in the backing material, either the person controlling the system, or the automated controller 38, will selectively instruct the actuator 26 to move the bow roll 17 into or out of the backing material for increasing or decreasing the tension therein in order to control any bow present in the central portion of the backing material.

Figure 5:
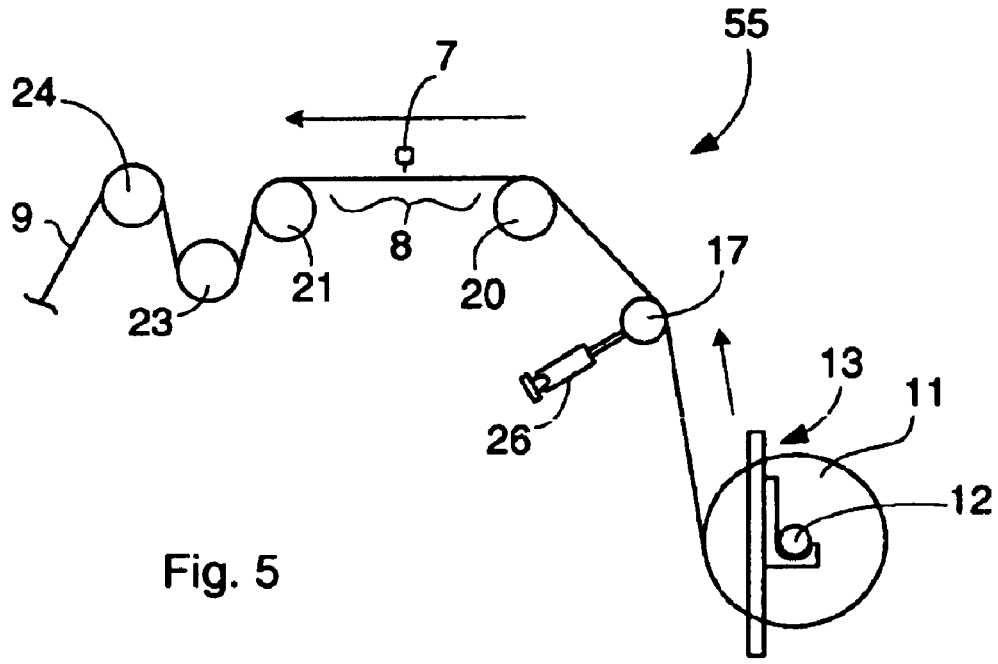
FIG. 5 is a schematic illustration of a second tufting machine supplied with a backing material from a roll of backing material.
Figure 6:
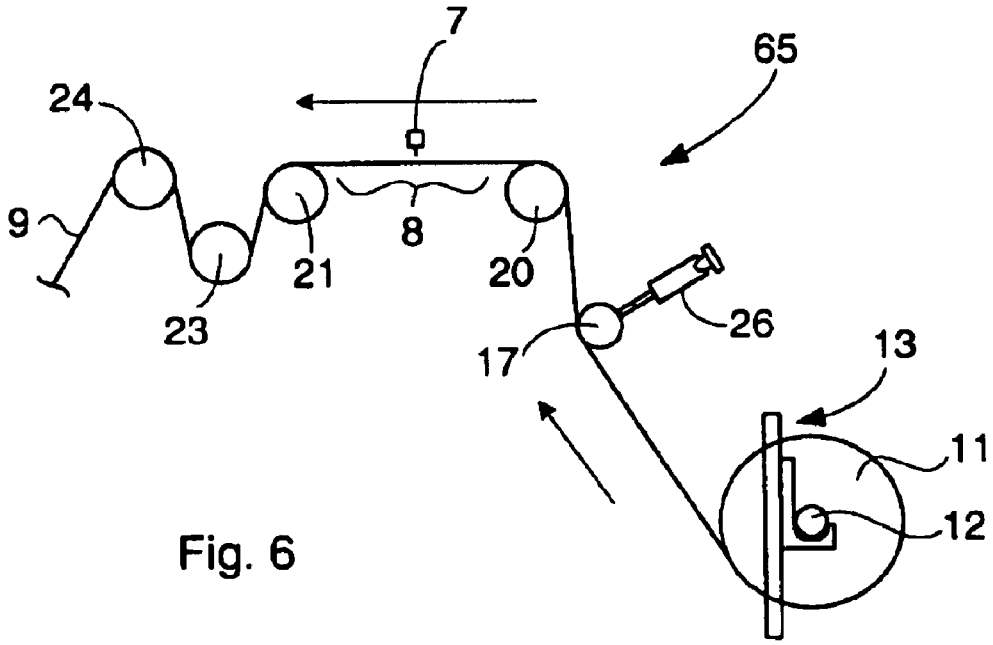
FIG. 6 is a schematic illustration of a third tufting machine supplied with a backing material from a roll of backing material.

Alternate tufting machines with which the bow and skew control system of this invention may be used are illustrated in FIGS. 5 and 6. Referring first to FIG. 5, a tufting machine 55 is shown in which all similarly illustrated elements are numbered identically. The tufting machine 55 does not have, however, the roll 15, the pin roll 16, nor the tension bar 19. Thus, and where for example the backing material is passed directly from the roll of backing material 11 to the cloth feed roll 20, the bow roll can be used as an idle roll or as a tension roll, as intended, for increasing and decreasing the tension of the backing material passed over the tufting machine, and more particularly the central portion thereof. Similarly, a tufting machine 65 is shown in FIG. 6, in which the bow roll 17 is oriented on the reverse surface of the backing material 9. Here the bow roll once again acts as either an idle roll or as a tension bar or roll, and is selectively used to increase or decrease the tension, i.e., for minimizing any bow that may be present within, the backing material that is passed toward the needle bar.

Figure 7:
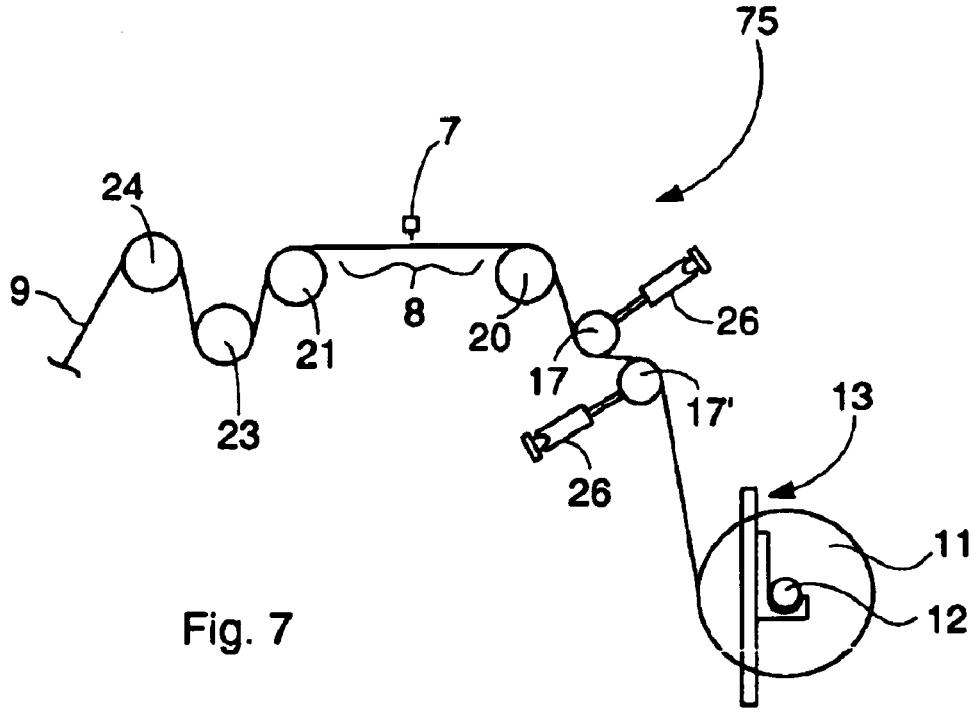
FIG. 7 is a schematic illustration of a fourth tufting machine provided with a pair of bow rolls and supplied with a backing material from a roll of backing material.

Another tufting machine adapted for use with the bow and skew control system of this invention is illustrated in FIG. 7. Here a tufting machine 75 is shown having a first bow roll 17 and a second bow roll 17', the two bow rolls being spaced from one another in the direction of the backing material passed toward the tufting zone 8, and also being positioned intermediate the roll of backing material and the cloth feed roll. It is anticipated that the two bow rolls in this embodiment of the system will be constructed and arranged to separately rotate about their respective axes rather than being elongate bars. As shown in FIG. 7, each of the two bow rolls may be provided with an actuator 26 of the type described above, which actuators are operably coupled to the controller 38 (FIG. 3) of the system so that they may be actuated together or separately, as desired.

Figure 8:
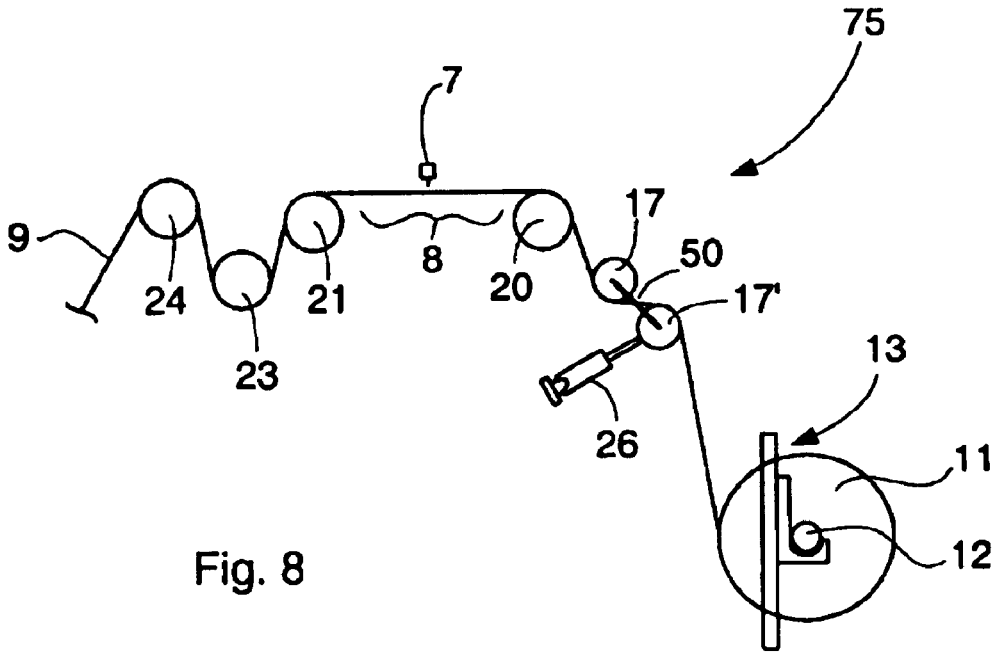
FIG. 8 is a schematic illustration of an alternate embodiment of the tufting machine of FIG. 7.

Alternately, and as schematically illustrated in FIG. 8, the two bow rolls 17, 17' may be tied or coupled together, forming a set of bow rolls or rollers, so that a single actuator operably coupled to the system controller may be used to move the respective bow rolls against the backing material passed thereover. In this construction, the two rotatable bow rolls 17, 17' are mounted on a frame 50 which will carry or move both of the bow rolls simultaneously with respect to the backing material. The frame itself may be moved by the actuator, as illustrated in FIG. 8, such that the two rollers are moved as a set toward and away from the needle bar for increasing and decreasing, respectively, the tension within the backing material passed toward the needle bar and thus controlling the bow within the backing material. Alternately, or additionally, each of the spaced ends of the frame may have a separate actuator assembly (not illustrated) positioned thereat and which is constructed to twist the respective frame ends for twisting the two rollers with respect to one another at either one or both of the respective ends of the set of rollers, as desired, which permits the bow rollers to also be used for controlling any skew within the backing material.

The bow rolls or rollers of the two bow roll embodiments of the invention described above may be constructed identically to the other embodiments of the bow roll described above, or may differ in their construction as desired. For example, the first bow roll 17 may have a concave surface, whereas the second bow roll 17' may have a convex surface. Constructed in this manner, a much greater degree of control over any bow present in the backing materials is available to the system operator and producer of tufted goods. No matter how constructed, operated, or configured, however, and as illustrated in the several embodiment of the system described above, the bow roll, be it a bar, a roller, or rollers, acts as either an idle roll or as a tension device used to selectively increase and decrease the tension of the backing material.

In each of the tufting machines 55, 65, and 75, it is anticipated that the roll of backing material 11 will rotate about the shaft 12, and that the shaft 12 will not rotate within the carrier 30 of the respective jack assemblies. However, and if so desired, it is anticipated that the roll of backing material 11 may be allowed to rotate with the shaft 12, the shaft rotating on or in the carriers 30, in which instance the carriers will be provided with suitable bearings, for example journal bearings or roller bearings. The weight of the roll of backing material will establish the tension in the backing material as it is passed over the cloth feed roll and into the tufting zone.

Moreover, it is also anticipated, although not illustrated, that a braking or friction device may be operably coupled to the shaft 12 for imparting and/or controlling the amount of tension in the backing material as it is passed from the roll of backing material toward the tufting machine without any intermediate pin roll(s), idle roll(s), or a tension bar assembly, using instead only the bow roll(s) to accomplish these functions in a way that also allows for the control of any bow that may be present in the backing material. It is also anticipated that each of the tufting machines of FIGS. 5–7 will have a jack assembly, or jack assemblies 13, which will be otherwise constructed and operated as described above.

Although several embodiments of the invention have been disclosed in the foregoing specification, it is understood by those skilled in the art that many modifications and other embodiments in the invention will come to mind to which the invention pertains, having the benefit of the teaching presented in the foregoing description and the associated drawings. It is thus understood that the invention is not limited to the specific embodiments disclosed hereinabove, and that many modifications and other embodiments are intended to be included within the scope of the invention. Moreover, although specific terms are employed herein, they are used only in a generic and descriptive sense, and not for the purposes of limiting the described invention, and the words "a," "and," or "the" as they appear hereinabove may mean one or more, depending upon the context in which the words are used.

We claim:

1. A system for controlling the bow and skew of a backing material fed through a tufting machine, the tufting machine having a reciprocating needle bar disposed with respect to a tufting zone through which the backing material is fed, a cloth feed roll positioned upstream of the tufting zone, a roll of backing material from which the backing material is supplied, the backing material having a plurality of elongate warp yarns extending longitudinally in the lengthwise direction of the backing material and a plurality of weft yarns extending substantially perpendicular to the warp yarns in the cross-length direction of the backing material, the system comprising:

at least one weft yarn marker disposed on the backing material, the at least one weft yarn marker being substantially parallel to the weft yarns of the backing material;

at least one detection device positioned with respect to the needle bar and being constructed and arranged to detect the at least one weft yarn marker as the backing material is being passed toward the tufting zone;

a bow roll positioned intermediate the cloth feed roil and the roll of backing material, the backing material being at least partially passed thereabout; and a controller operably coupled to the at least one detection device and the bow roll.

2. The system of claim 1, wherein the bow roll is constructed and arranged to increase or decrease the tension of at least a portion of the backing material passed thereover.

3. The system of claim 1, wherein the bow roll is constructed and arranged to increase or decrease the tension of a central portion of the backing material passed thereover.

4. The system of claim 1, wherein the bow roll is constructed and arranged to be moved to increase or decrease the tension in the backing material passed thereover.

5. The system of claim 1, further comprising an actuator operably coupled to the controller and being constructed and arranged to move the bow roll with respect to the backing material to increase or decrease the tension of the backing material.

6. The system of claim 5, wherein the actuator comprises a linear actuator.

7. The system of claim 1, further comprising at least one jack assembly constructed and arranged to carry the roll of backing material.

8. The system of claim 7, the at least one jack assembly being operably coupled to the controller, and being constructed and arranged to raise and lower the respective ends of the roll of backing material independently of one another to increase and decrease the tension of the backing material passed toward the tufting zone.

9. The system of claim 7, the at least one jack assembly being operably coupled to the controller, and being constructed and arranged to raise one end of the roll of backing material and to simultaneously lower the other end of the roll of backing material independently of one another to increase and decrease the tension of the backing material passed toward the tufting zone.

10. The system of claim 1, further comprising a spaced pair of jack assemblies positioned at the ends of the roll of backing material, each of the jack assemblies being constructed and arranged to carry an end of the roll of backing material.

11. The system of claim 10, each of the jack assemblies being operably coupled to the controller and being selectively instructed by the controller to raise or lower the respective ends of the roll of backing material independently of one another to increase or decrease the tension of at least a portion of the backing material passed toward the tufting zone.

12. The system of claim 10, each of the jack assemblies being operably coupled to the controller, each of the jack assemblies being constructed and arranged to raise and lower the respective ends of the roll of backing material independently of one another to increase or decrease the tension of at least a portion of the backing material passed toward the tufting zone.

13. The system of claim 12, wherein the respective jack assemblies increase and decrease the tension of at least one of two spaced and separate edge portions extending along the respective and separate side edge portions of the backing material passed from the roll of backing material toward the tufting zone.

14. The system of claim 1, the at least one weft yarn marker comprising a plurality of parallel weft yarn markers disposed on the backing material and spaced from one another in the lengthwise direction of the backing material.

15. The system of claim 1, the at least one weft yarn marker comprising further comprising a series of parallel weft yarn marker groups disposed on the backing material and spaced from one another in the lengthwise direction of the backing material.

16. The system of claim 1, wherein the at least one detection device is positioned downstream of the cloth feed roller.

17. The system of claim 1, the at least one detector comprising a plurality of detectors spaced from one another in the weft direction of the backing material and being positioned parallel to the needle bar.

18. The system of claim 1, the at least one detector being selected from at least one of the detectors in the group of detectors comprising optical, laser, magnetic, electronic, infra-red, and ultrasonic detectors.

19. The system of claim 1, the at least one weft yarn marker being selected from at least one of the markers in the group of markers comprising optical, laser readable, magnetic, electronic, infra-red, and ultrasonic markers.

20. The system of claim 1, further comprising at least one jack assembly constructed and arranged to carry the roll of backing material, wherein the controller selectively instructs a first actuator operably coupled to the bow roll to move the bow roll against the backing material supply, and instructs at least one second actuator operably coupled to the at least one jack assembly to raise and lower at least one end of the roll of backing material, respectively, to selectively increase and decrease the tension of the backing material being passed toward the tufting zone in response to the detection of the at least one weft yarn marker not being substantially parallel to the needle bar.

21. The system of claim 1, further comprising a second bow roll spaced from said bow roll and also being positioned intermediate the cloth feed roll and the roll of backing material, the second bow roll being operably coupled to the at least one detection device and the controller.

22. A system for controlling the bow and skew of a backing material fed through a tufting machine, the tufting machine having a reciprocating needle bar disposed with respect to a tufting zone through which the backing material is fed, a cloth feed roll positioned upstream of the tufting zone, a roll of backing material from which the backing material is supplied, the backing material having a plurality of elongate warp yarns extending longitudinally in the lengthwise direction of the backing material and a plurality of weft yarns extending substantially perpendicular to the warp yarns in the cross-length direction of the backing material, the system comprising:

at least one elongate weft yarn marker disposed on the backing material, the at least one weft yarn marker being substantially parallel to the weft yarns of the backing material;

at least one detection device positioned with respect to the needle bar and being constructed and arranged to detect the at least one weft yarn marker as the backing material is passed toward the tufting zone;

a bow roll positioned intermediate the cloth feed roll and the roll of backing material, the backing material being at least partially passed thereabout, wherein the bow roll is constructed and arranged to increase and decrease the tension of the backing material passed toward the tufting zone;

at least one jack assembly positioned with respect to the roll of backing material, the at least one jack assembly being constructed and arranged to carry the roll of backing material thereon and being constructed and arranged to raise and lower the respective ends of the roll of backing material independently of one another to increase and decrease the tension of the backing material passed toward the tufting zone; and a controller operably coupled to the at least one detection device, the bow roll, and the at least one jack assembly, respectively.

23. The system of claim 22, wherein the controller selectively instructs a first actuator operably coupled to the bow roll to move the bow roll against the backing material, and instructs at least one second actuator operably coupled to the at least one jack assembly to raise and lower at least one end of the roll of backing material, respectively, in response to the detection of the at least one weft yarn marker not being substantially parallel to the needle bar.

24. The system of claim 22, wherein the controller is automated.

25. The system of claim 22, wherein the controller is manually operated.

26. A system for controlling the bow and skew of a backing material fed through a tufting machine, the tufting machine having a reciprocating needle bar disposed with respect to a tufting zone through which the backing material is fed, a cloth feed roll positioned upstream of the tufting zone, a roll of backing material from which the backing material is supplied, the backing material having a plurality of elongate warp yarns extending longitudinally in the lengthwise direction of the backing material and a plurality of weft yarns extending substantially perpendicular to the warp yarns in the cross-length direction of the backing material, the system comprising:

at least one elongate weft yarn marker disposed on the backing material and being substantially parallel to the weft yarns of the backing material;

at least one detection device positioned with respect to the needle bar and being constructed and arranged to detect the at least one weft yarn marker as the backing material is being passed toward the tufting zone;

a bow roll positioned intermediate the cloth feed roll and the roll of backing material, the backing material being at least partially passed thereabout, wherein the bow roll is constructed and arranged to increase and decrease the tension of the backing material passed toward the tufting zone;

a jack assembly positioned at each respective end of the roll of backing material, each of the jack assemblies being constructed and arranged to carry an end of the roll of backing material and to raise and lower the respective ends of the roll of backing material independently of one another to increase and decrease the tension of the backing material passed toward the tufting zone; and a controller operably coupled to the at least one detection device, the bow roll, and to each respective jack assembly.

27. The system of claim 26, wherein the controller selectively instructs a first actuator operably coupled to the bow roll to move the bow roll, and selectively instructs one or both of a pair of second actuators operably coupled one each to one of the respective jack assemblies to raise and lower at least one end of the roll of backing material independently of one another.

28. A system for controlling the bow and skew of a backing material fed through a tufting machine, the tufting machine having a reciprocating needle bar disposed with respect to a tufting zone through which the backing material is fed, a cloth feed roll positioned upstream of the tufting zone, a roll of backing material from which the backing material is supplied, the backing material having a plurality of elongate warp yarns extending longitudinally in the lengthwise direction of the backing material and a plurality of weft yarns extending substantially perpendicular to the warp yarns in the cross-length direction of the backing material, the system comprising:

a plurality of closely spaced and substantially parallel weft yarn markers disposed on the backing material and formed as a group of weft yarn markers, each of the weft yarn markers within the group being spaced from one another in the lengthwise direction of the backing material and being substantially parallel to the weft yarns of the backing material;

at least one detection device positioned with respect to the needle bar and being constructed and arranged to detect the weft yarn markers as the backing material is being passed thereby and toward the tufting zone;

a bow roll positioned intermediate the cloth feed roll and the roll of backing material, the backing material being at least partially passed thereabout, the bow roll being constructed and arranged to increase and decrease the tension of the backing material passed thereover;

at least one jack assembly constructed and arranged to carry the roll of backing material thereon and to raise and lower the respective ends of the roll of backing material independently of one another to increase and decrease the tension of the backing material passed toward the tufting zone; and a controller operably coupled to the at least one detection device, the bow roll, and the at least one jack assembly, respectively.

* * * * *

UNITED STATES PATENT AND TRADEMARK OFFICE

CERTIFICATE OF CORRECTION

PATENT NO. : 6,776,109 B2
DATED : August 17, 2004
INVENTOR(S) : Segars et al.

It is certified that error appears in the above-identified patent and that said Letters Patent is hereby corrected as shown below:

Column 13,
Line 28, please delete the word "roil" and substitute the following -- roll --

Signed and Sealed this

Thirtieth Day of November, 2004

JON W. DUDAS
*Director of the United States Patent and Trademark Office*